US006730465B2

(12) United States Patent
Allway et al.

(10) Patent No.: US 6,730,465 B2
(45) Date of Patent: May 4, 2004

(54) COLOR PHOTOGRAPHIC ELEMENT CONTAINING A HETEROCYCLIC DYE-FORMING COUPLER

(75) Inventors: Philip A. Allway, Rickmansworth (GB); Paul L. Stanley, Middlesex (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/385,049

(22) Filed: Mar. 10, 2003

(65) Prior Publication Data

US 2003/0207219 A1 Nov. 6, 2003

(30) Foreign Application Priority Data

Mar. 15, 2002 (GB) ..... 0206089

(51) Int. Cl.[7] ..... G03C 1/08; G03C 7/26; G03C 7/32

(52) U.S. Cl. ..... 430/558; 430/385; 430/387; 430/955

(58) Field of Search ..... 430/543, 558, 430/385, 387, 955

(56) References Cited

U.S. PATENT DOCUMENTS 5,262,292 A 11/1993 Krishnamurthy et al.
5,681,691 A 10/1997 Bose et al.

FOREIGN PATENT DOCUMENTS

EP 0 287 073 8/1995
JP 5-127326 5/1993

OTHER PUBLICATIONS

Abstract of JP 5–127326 (Compound 16, P. 318).

*Primary Examiner*—Geraldine Letscher
(74) *Attorney, Agent, or Firm*—Arthur E. Kluegel

(57) ABSTRACT

The invention relates to a photographic element comprising at least one light-sensitive silver halide emulsion layer having associated therewith a heterocyclic magenta or cyan dye-forming coupler of formula (I), (I)

wherein

HET is a heterocyclic coupler comprising at least two fused rings and having at least one bridgehead nitrogen atom;

S is bonded to a position of HET capable of releasing the heterocyclylthio moiety from HET upon reaction with oxidized developer;

X is a heteroatom selected from nitrogen, oxygen and sulfur, bonded to the carbon atom bearing the exocyclic S and to other ring atoms only; and Z are the atoms necessary to complete an unsubstituted or substituted heterocyclic ring or ring system, which may contain one or more other heteroatoms selected from nitrogen, oxygen and sulfur;

provided also that the heterocyclylthio moiety released upon reaction with oxidized developer does not significantly inhibit silver development nor cause a bleach acceleration effect.

The couplers have good activity and the heterocyclylthio coupling-off groups can comprise or be linked to photographically useful groups, such as dyes, development accelerators or electron transfer agents, thereby providing a practical way of attaching these groups to fused heterocyclic ring systems.

21 Claims, 1 Drawing Sheet

COLOR PHOTOGRAPHIC ELEMENT CONTAINING A HETEROCYCLIC DYE-FORMING COUPLER

FIELD OF THE INVENTION

The present invention relates to a silver halide color photographic element containing a magenta or cyan dye-forming coupler, and in particular a fused ring heterocyclic dye-forming coupler capable of carrying a photographically useful group.

BACKGROUND OF THE INVENTION

In silver halide based color photography, a typical photographic element contains multiple layers of light-sensitive photographic silver halide emulsions coated on a support with one or more of these layers being spectrally sensitized to each of blue light, green light and red light. The blue, green and red light-sensitive layers typically contain, respectively, yellow, magenta and cyan dye-forming couplers, hereinafter 'couplers'. These couplers provide yellow, magenta and cyan dyes in the so-called subtractive color process to reproduce their complementary colors blue, green and red as in the original image. After exposure to light, color development is accomplished by immersing the exposed material in an aqueous alkali solution containing an aromatic primary amine color developing agent. The couplers are selected so as to react efficiently with the oxidized color developing agent so formed, thereby minimizing the amounts of coupler and silver halide necessary in the photographic element A variety of coupler types have been used in photographic materials. Among the known couplers are cyclic azoles, in particular those containing bridgehead nitrogen 5,5; 5,6 or 5,5,6 fused ring systems, such as pyrazolotriazoles, pyrazolotriazines, pyrazolopyrimidines, pyrazolothiadiazines, pyrrolotriazoles, imidazopyrazoles and pyrazolobenzimidazoles, for example as described in EP-A-0 119 860, EP-A-0 269 436, EP-A-0 398 664, EP-A-0 714 892, EP-A-0 744 655, EP-A-0 802 454, EP-A-0 883 024, U.S. Pat. Nos. 4,916,051, 4,950,585, 4,970,142, 5,451, 501, 5,776,669 and 6,132,945 and JP 04125557. These couplers may form magenta or cyan dyes depending on the ring structure and substituents.

A coupling-off group is a group adapted to split off from the coupler as the result of the reaction between the coupler and the oxidation product of an arylamine color developing agent. Coupling-off groups can determine the equivalency of the coupler, can modify the reactivity of the coupler or can, where required, advantageously affect the layer in which the coupler is coated or other layers in the element by performing, after the release from the coupler, such functions as development inhibition, development acceleration, bleach inhibition, bleach acceleration or color correction. Typical examples of coupling-off groups include, for example, halogen, alkoxy, aryloxy, sulfonyloxy, acyloxy, phosophonyloxy, heterocyclyloxy, acyl, heterocyclyl, sulfonamido, benzothiazolyl, alkylthio, arylthio, heterocyclylthio and arylazo groups. These coupling-off groups are described in the art, for example, in U.S. Pat. Nos. 2,455, 169, 3,227,551, 3,432,521, 3,467,563, 3,617,291, 3,880,661, 4,052,212 and 4,134,766; and in UK Patent Nos. and published applications 1,466,728, 1,531,927, 1,533,039, 2,066, 755A and 2,017,704A, the disclosures of which are incorporated herein by reference.

However the number of coupling-off group moieties which form good couplers in combination with fused ring heterocyclic systems, such as for example pyrazoloazoles, is limited. A commonly used coupling-off 'group' for these systems is a chloro atom, as described, for example, in U.S. Pat. No. 5,681,691. Whilst arylthio groups are disclosed in U.S. Pat. No. 5,262,292 as acting as good coupling-off groups for pyrazolone couplers, they do not act as such for fused ring heterocyclic systems, even when a solubilising group such as a carboxylic acid is present. Couplers containing heteroarylthio coupling-off groups, wherein the coupling-off group functions as an inhibitor, include mercaptothiadiazoles, mercaptooxadiazoles or, as disclosed for example in JP 05127326, mercaptotetrazoles. Being inhibitors these heterocycles affect development and couplers containing them are 'Development Inhibitor Releasing' couplers (DIRs). Couplers wherein the coupling-off group functions as a bleach accelerator are disclosed, for example, in EP-A-0 287 073.

PROBLEM TO BE SOLVED BY THE INVENTION

There is a need for coupling-off groups for fused ring heterocyclic ring systems having at least one bridgehead nitrogen atom which can confer satisfactory activity on the couplers and which can comprise or be linked to photographically useful groups (PUGs), such as dyes, development accelerators and electron transfer agents, without the coupling-off group having an inhibitory effect on silver development or causing a bleach acceleration effect. Whilst a chloro coupling-off group on such couplers provides the necessary activity, it is not possible to link a PUG thereto. Although a PUG can be linked to an arylthio coupling-off group, for the fused ring heterocyclic ring systems above a coupler including such a group is not sufficiently active for practical use.

SUMMARY OF THE INVENTION

It has now been found that, when a heterocyclylthio coupling-off group is linked to a heterocyclic coupler containing at least two fused rings and having at least one bridgehead nitrogen atom, not only does the resulting coupler possess the required activity but the heterocyclylthio moiety released upon reaction with oxidized developer does not significantly inhibit silver development nor cause a bleach acceleration effect.

According to the present invention therefore there is provided a photographic element comprising at least one light-sensitive silver halide emulsion layer having associated therewith a heterocyclic magenta or cyan dye-forming coupler of formula (I),

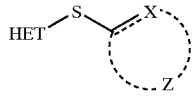

(I)

wherein

HET is a heterocyclic coupler comprising at least two fused rings and having at least one bridgehead nitrogen atom;

S is bonded to a position of HET capable of releasing the heterocyclylthio moiety from HET upon reaction with oxidized developer;

X is a heteroatom selected from nitrogen, oxygen and sulfur, bonded to the carbon atom bearing the exocyclic S and to other ring atoms only; and Z are the atoms necessary to complete an unsubstituted or substituted heterocyclic ring or ring system, which may contain one or more other heteroatoms selected from nitrogen, oxygen and sulfur;

provided also that the heterocyclylthio moiety released upon reaction with oxidized developer does not significantly inhibit silver development nor cause a bleach acceleration effect.

In another embodiment of the invention there is provided a multi-color photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element includes a heterocyclic magenta or cyan dye-forming coupler of formula (I) as herein described.

In yet another embodiment of the invention there is provided a process of forming an image in a photographic element as hereinbefore defined after the element has been imagewise exposed to light, comprising contacting the element, as herein described, with a color developing agent.

ADVANTAGEOUS EFFECT OF THE INVENTION

In addition to the couplers herein described having the required activity, the heterocyclylthio coupling-off groups can comprise or be linked to PUGs, such as dyes, development accelerators or electron transfer agents, thereby providing a practical way of attaching these groups to fused heterocyclic ring systems.

DETAILED DESCRIPTION OF THE INVENTION

Figure 1:
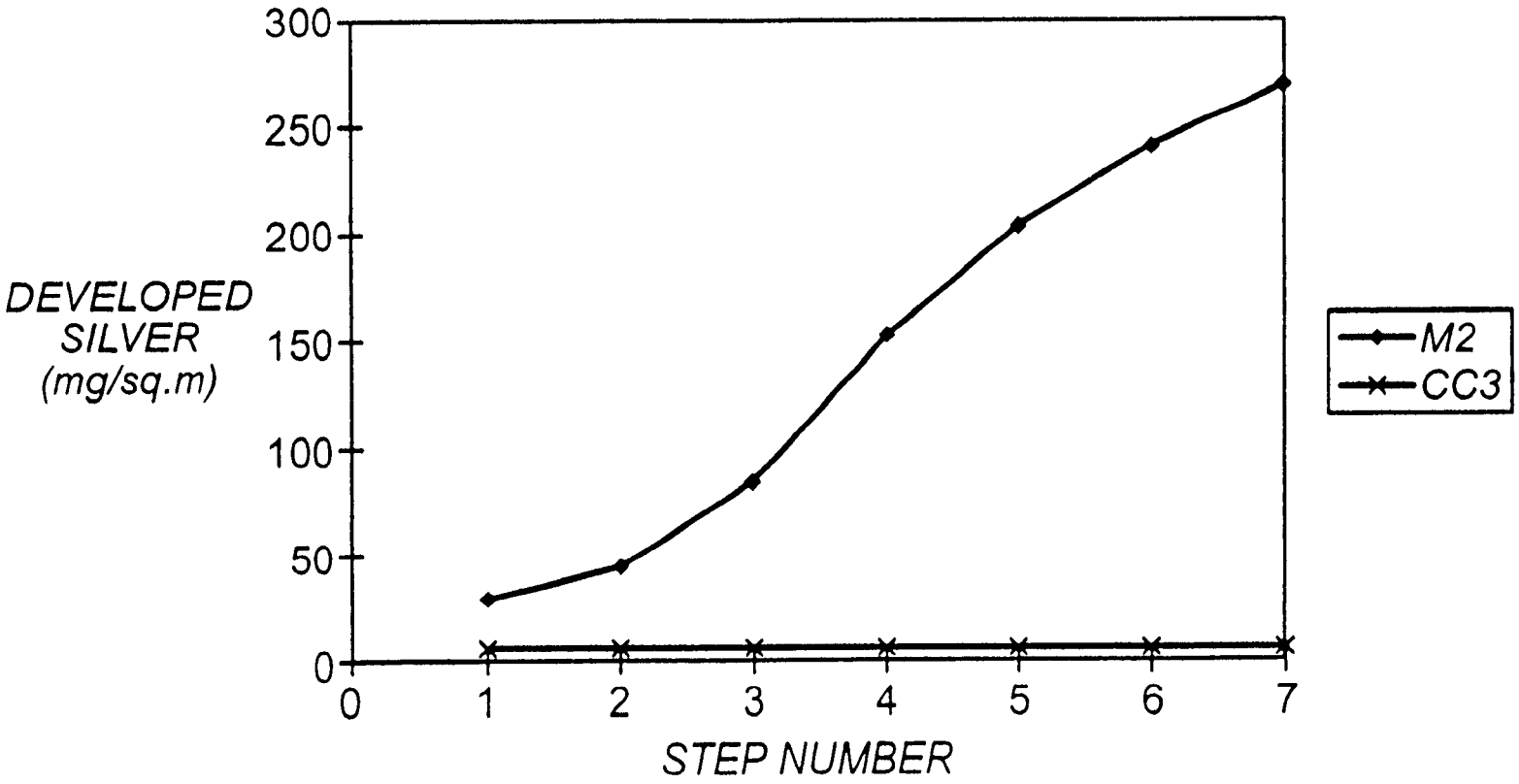
FIG. 1 shows the silver development curves for coupler M2 for use in the invention and control coupler CC3.

The invention is as described in the Summary of the Invention and relates to a photographic element containing a heterocyclic magenta or cyan coupler, comprising at least two fused rings and having at least one bridgehead nitrogen atom and being capable of carrying a PUG.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, having 3–8 carbon atoms and the term "aryl" includes specifically fused aryl.

The couplers for use in this invention can be based on any heterocyclic coupler having at least two fused rings and having at least one bridgehead nitrogen, preferably a coupler comprising a 5-membered ring fused to a ring or ring system having from 5–10 carbon atoms. More preferably the coupler is a 5,5; 5,6 or 5,5,6 fused ring system. 5,5 fused ring systems may include, for example, pyrazolo[5,1-c][1,2,4]triazoles, pyrazolo[1,5-b][1,2,4]-triazoles, pyrrolo[2,3-b]pyrazoles, pyrrolo[1,5-b][1,2,4]triazoles, imidazo[1,2-b]-pyrazoles, imidazo[1,5-b]pyrazoles, imidazo[1,2-a]imidazoles, imidazo[1,2-b]-[1,2,4]triazoles, imidazo[2,1-c][1,2,4]triazoles, imidazo[5,1-c][1,2,4]triazoles and triazolo[3,4-c][1,2,4]triazoles. 5,6 fused ring systems may include, for example, pyrazolo[1,5-a]pyrimidines, pyrazolo[1,5-b][1,2,4]thiadiazines, pyrazolo[5,1-c]-[1,2,4]thiadiazines, pyrazolo[5,1-c][1,2,4]triazines and pyrazolo[1,5-a][1,3,5]-triazines and 5,5,6 fused ring systems may include, for example, pyrazolo[3,2-b]-benzimidazoles.

Preferably the couplers are selected from pyrazolotriazoles, pyrrolotriazoles, imidazopyrazoles, pyrazolopyrimidines, pyrazolothiadiazines, pyrazolotriazines and pyrazolobenzimidazoles. Single ring heterocycles, such as pyrazolones, are specifically excluded from the scope of this invention.

Preferred couplers are selected from the following formulae (II) and (III):

(II)

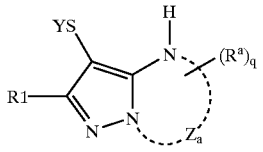

(III)

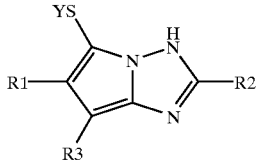

wherein $R^1$, $R^2$ and $R^3$ are independently hydrogen or a substituent;

each $R^a$ is an independently selected substituent and two $R_a$ groups may join to form a ring;

q is 0 to 4;

$Z^a$ represents the atoms necessary to complete an unsubstituted or substituted heterocyclic ring or ring system which may contain one or more other heteroatoms selected from nitrogen, oxygen and sulfur;

providing that each $R^a$ is attached to a carbon atom of the ring; and

Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

One particularly preferred embodiment of a compound of formula (II) has the formula (IIA)

(IIA)

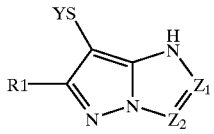

wherein $Z^1$ and $Z^2$ are independently nitrogen atoms, —CH— groups or —CR— groups, wherein R is a substituent; or when both $Z^1$ and $Z^2$ are —CR— groups they may combine to form an unsubstituted or substituted ring or ring system; and $R^1$ and Y are as defined for formula (II);

Structures falling within formula (IIA) may, for example, be one of the following:

(a)

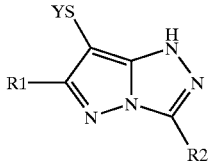

(b)

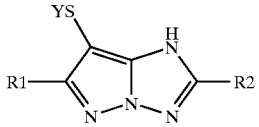

(c)

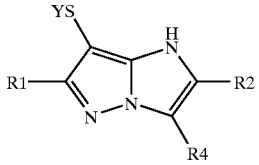

(d)

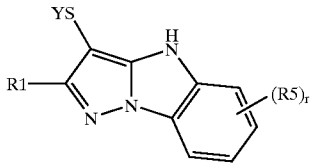

wherein $R^2$, $R^4$ and each $R^5$ are independently hydrogen or a substituent;

or $R^2$ and $R^4$ may combine to form an unsubstituted or substituted ring or ring system;

r is 0 to 4; and $R^1$ and Y are as defined for formula (II).

Alternatively the compound of formula (II) may have the structure (IIB):

(IIB)

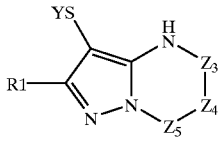

wherein one of $Z^3$ and $Z^5$ is a carbonyl or sulfonyl group and the other of $Z^3$ and $Z^5$ is a nitrogen atom, CH— or —CR— group, wherein R is a substituent;

$Z^4$ is a nitrogen atom or a —CH— or —CR— group; or $Z^4$ and the other of $Z^3$ and $Z^5$ may together form an unsubstituted or substituted ring or ring system; and $R^1$ and Y are as defined for formula (II).

Structures falling within formula (IIB) may, for example, be one of the following:

(e)

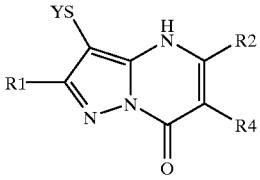

(f)

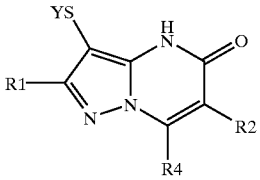

(g)

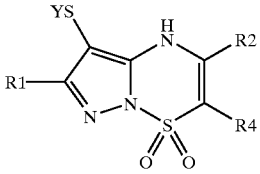

(h)

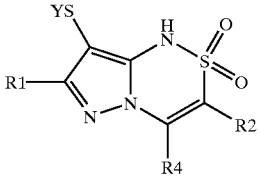

(i)

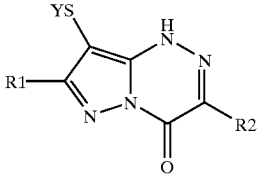

(j)

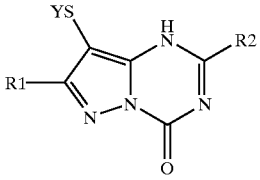

wherein $R^2$ and $R^4$ are independently hydrogen or a substituent; or $R^2$ and $R^4$ may combine to form an unsubstituted or substituted ring or ring system; and $R^1$ and Y are as defined for formula (II).

In formulae IIA and IIB, when —CR— groups combine to form a ring, this may be an unsubstituted or substituted 5- to 10-membered carbocyclic or heterocyclic ring which may contain one or more heteroatoms selected from nitrogen, oxygen and sulfur, which ring is unsubstituted or substituted.

Generally a cyan coupler of formula (II) may have any of the above structures (a) to (j), with (a) being the preferred structure, but a magenta coupler of formula (II) will normally have any one of the structures (a), (b) or (d). Couplers of formula (III) will generally be cyan. Whether a particular coupler is a cyan or magenta coupler is determined by the substituent groups present on the ring system. For example the cyan and magenta couplers will have electron-withdrawing and electron-donating substituents respectively in the ring system. Appropriate combinations of $R^1$ to $R^5$ may result in dyes having a reddish or bluish color and are specifically included within the scope of 'cyan' or 'magenta' for the purposes of this invention.

$R^1$, $R^2$, $R^3$, $R^4$ and $R^5$ may be independently selected from hydrogen, cyano, fluoro, chloro, bromo, iodo, nitro, carboxylic acid, sulfonic acid; or an unsubstituted or substituted alkyl, aryl, heterocyclyl, alkoxy, aryloxy, alkyl- or aryl-carbonyl, alkyl- or aryl-oxycarbonyl, alkyl- or aryl-carbonyloxy, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, alkyl- or aryl-amino, alkyl- or aryl-ureido or alkyl- or aryl-carbamoyl group. When any of $R^1$ to $R^5$ is substituted with one or more substituents, these may be selected, for example, from the above list and these may in turn be further so substituted.

Preferably $R^1$ is selected from a cyano or an unsubstituted or substituted alkyl, aryl, alkoxy, aryloxy, or alkyl- or aryl-carbamoyl or alkyl- or aryl-carbonamido group.

$R^2$ and $R^3$ are preferably independently selected from hydrogen or an unsubstituted or substituted alkyl, including trifluoromethyl, aryl, alkyl- or aryl-oxycarbonyl or alkyl- or aryl-carbonyloxy group. A particularly preferred group for $R^2$ is an alkyl group substituted with a group $N(R_1)C(=O)R_2$, wherein $R_1$ is an unsubstituted or substituted alkyl group and $R_2$ is an unsubstituted or substituted aryl group $R^4$ is preferably hydrogen or $R^2$ and $R^4$ may join to form an unsubstituted or substituted 5- to 10-membered carbocyclic or heterocyclic ring which may contain one or more heteroatoms selected from nitrogen, oxygen and sulfur, which ring is unsubstituted or substituted.

Each $R^5$ is conveniently hydrogen or a substituent as hereinbefore listed, especially a substituent at either or both of the positions of the phenyl ring not adjacent to the carbon atoms shared with the adjoining ring.

The coupling-off group S—Y may be any group that, when released upon reaction with oxidized developer, does not significantly inhibit silver development nor cause a bleach acceleration effect. By 'does not significantly inhibit' it is meant that, in comparison with an element not containing a coupler of formula (I), in an element containing such a coupler from which S—Y is released, S—Y is any group that neither (a) causes less than about 20% reduction in the total amount of silver developed, nor (b) increases the rate at which the silver metal produced in forming the image is oxidized to silver salts by less than about 20%.

Preferably the reduction in the total amount of silver developed is less than about 10%, more preferably less than about 5%, and the increase in the rate at which the silver metal is oxidized is less than about 10%, more preferably less than about 5%.

Suitably Y is a 5- to 10-membered unsubstituted or substituted heterocyclic ring or ring system, which may contain one or more other heteroatoms selected from nitrogen, oxygen and sulfur and which may include one or more carbonyl groups.

In particular Y is a 5- to 8-membered ring or ring system and is especially, for example, a pyridine, pyrimidine, pyrazine, triazine, pyridazine, thiazole, isothiazole, oxazole, imidazole, pyrazole, isoxazole, oxazine, pyrrole, cyclopentadienylpyrrole, triazepine or thiin. Specifically Y cannot comprise any ring or ring system capable of inhibiting the development of silver halide such as, for example, a tetrazole, an oxadiazole, a thiadiazole or a triazole.

Y may be unsubstituted or substituted, for example, with any one or more of the substituents listed herein for $R^1$ to $R^5$ and in particular with a cyano, carboxylic acid, or an unsubstituted or substituted alkyl- or aryl-carbonyloxy, alkyl- or aryl-oxycarbonyl, alkyl- or aryl-sulfonamido, alkyl- or aryl-sulfamoyl, alkyl- or aryl-carbonamido, alkyl- or aryl-carbamoyl, alkyl- or aryl-amino, alkoxy aryloxy or heterocyclyl group, or may also be substituted, for example, with an alkylidene, azomethine or imino group or the ring or rings of Y include one or more carbonyl groups.

Y may itself comprise or be linked to a PUG, such as a dye, development accelerator or electron transfer agent. Suitable linking groups may be, for example, unsubstituted or substituted alkyl, aryl, heterocyclyl, alkyl- or aryl-carbamoyl, alkyl- or aryl-carbonamido, alkyl- or aryl-sulfonamido, alkyl- or aryl-sulfamoyl, alkyl- or aryl-carbonyloxy, alkyl- or aryl-ester, alkyl- or aryl-sulfone, alkyl- or aryl-sulfoxide, alkyl- or aryl-sulfide, alkyl- or aryl-amino or alkyl- or aryl-ether groups. It is preferred that the linking group comprises less than 10 carbon atoms.

It is important that the substituent groups $R^1$ to $R^5$, $R^a$ and groups on Y are selected so as to adequately ballast the coupler and the resulting dye in the organic solvent in which the coupler is dispersed. The ballasting may be accomplished by providing hydrophobic substituent groups in one or more of these substituent groups. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of these substituent groups in the couplers for use in the invention are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. Furthermore, even if the coupling-off group contains a ballast it is often necessary to ballast the other substituents as well, since the coupling-off group is eliminated from the molecule upon coupling.

The following examples further illustrate heterocyclic couplers that may be used in the invention. It is not to be construed that the present invention is limited to these examples.

Magenta Couplers
M1
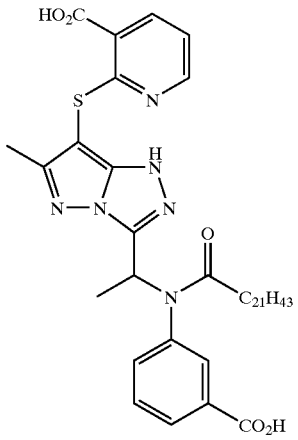
M2
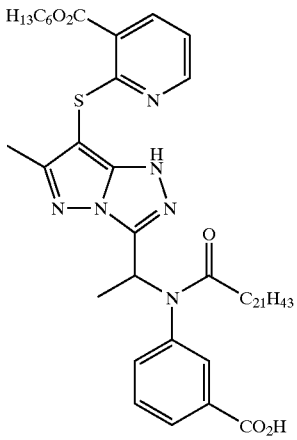
M3
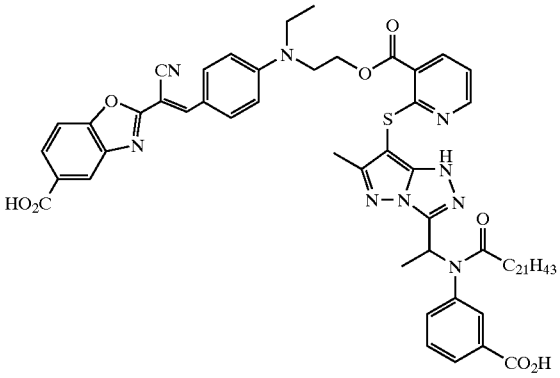
M4
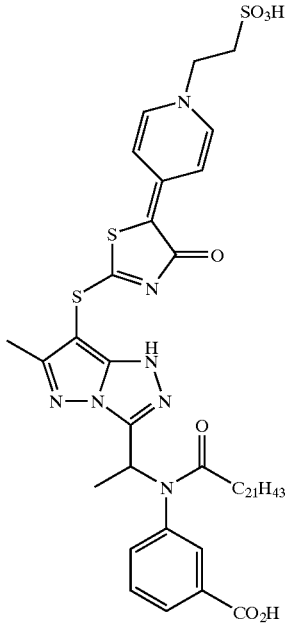
M5
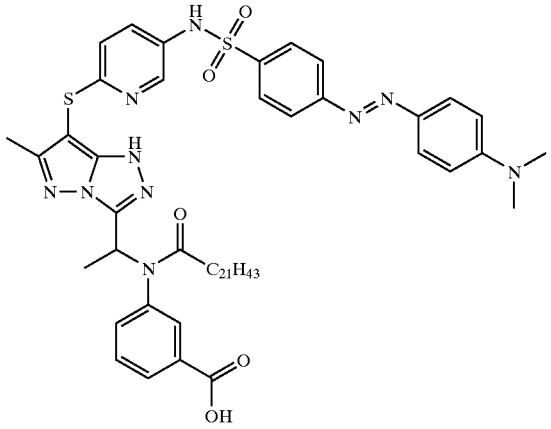
M6
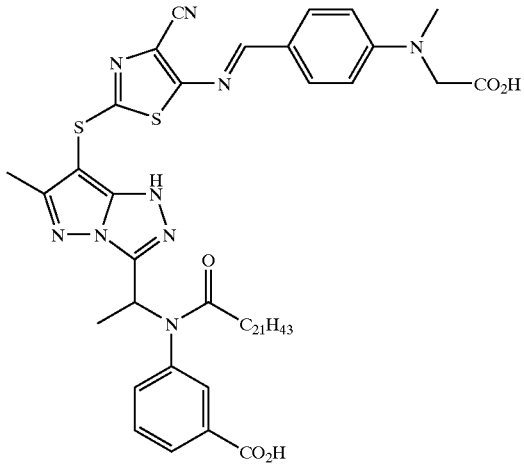

-continued
M7
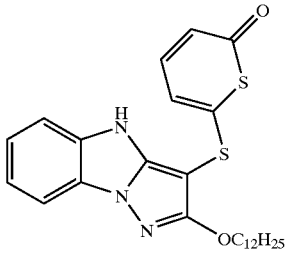
M8
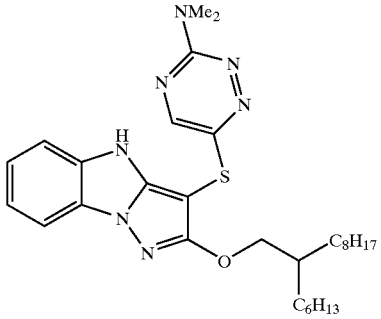
M9
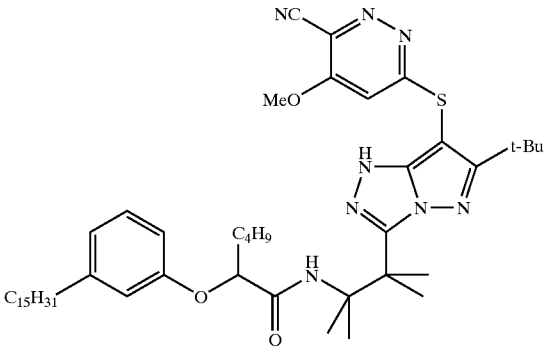
M10
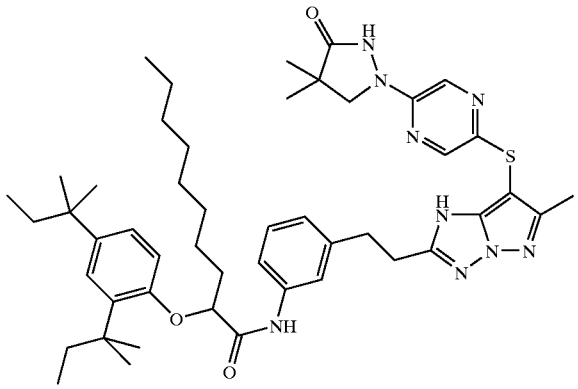
Cyan couplers
M11
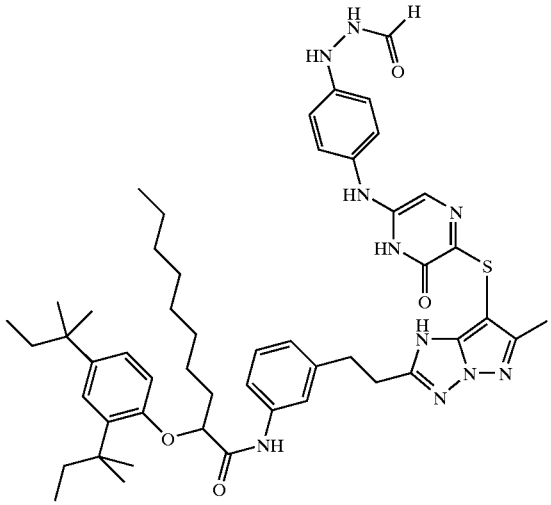
C1
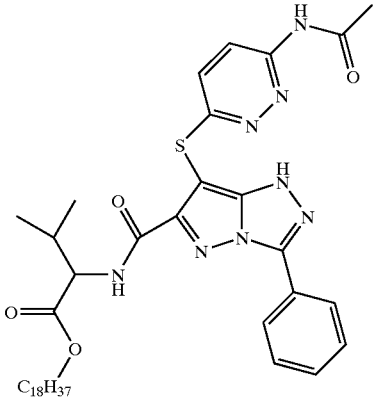

-continued
C2
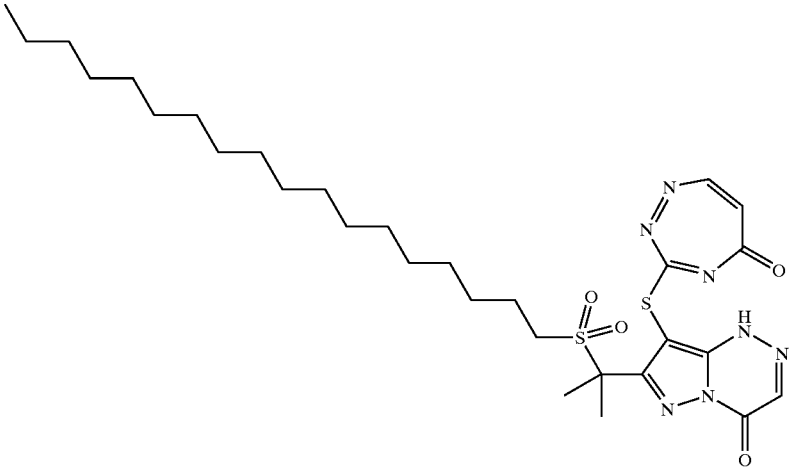
C3
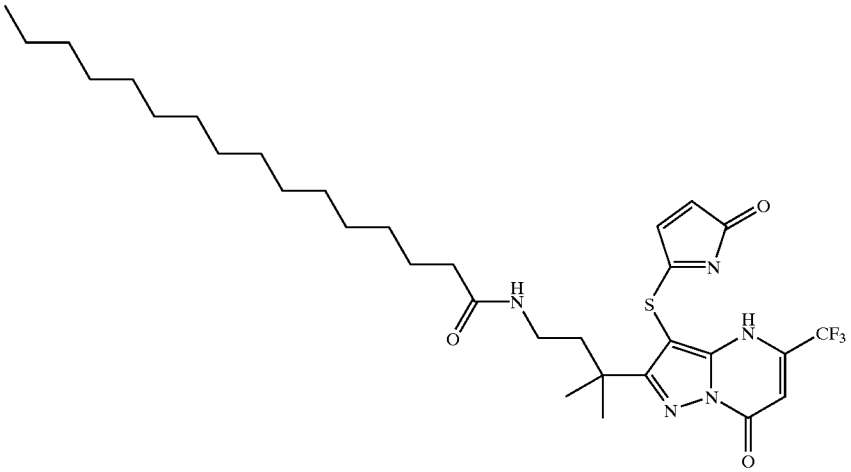
C4
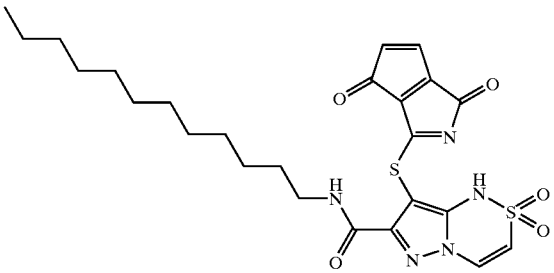
C5
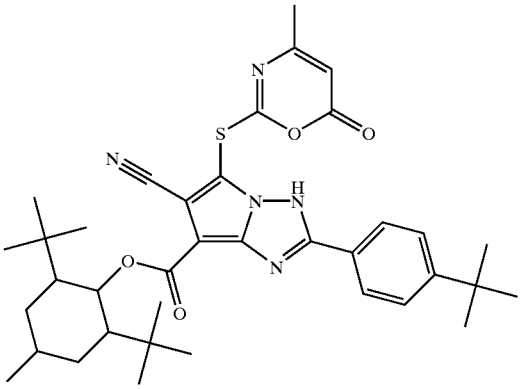

-continued

C6

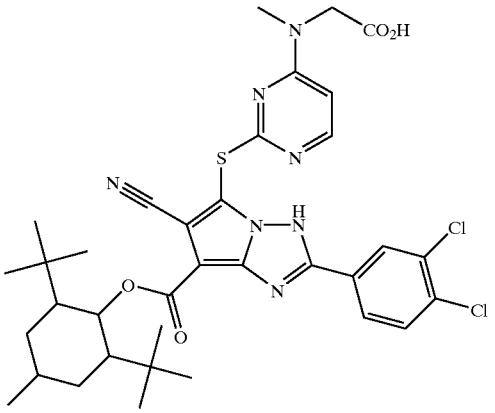

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyloxyethoxy; aryl such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxy-carbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-di-phenylureido, N-phenyl-N-p-toluylureido, N-(m-hexa-decylphenyl) ureido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino and hexadecylsulfonamido; sulfamoyl, such as N-methyl-sulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl and N-dodecylsulfamoyl; carbamoyl, such as N-methylcarbamoyl, N,N-dibutyl-carbamoyl, N-octadecylcarbamoyl, N-[4-(2,4-di-t-pentylphenoxy)butyl]-carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxy-phenoxycarbonyl, methoxycarbonyl, butoxycarbonyl, tetradecyloxycarbonyl, ethoxycarbonyl, benzyloxycarbonyl, 3-pentadecyloxycarbonyl and dodecyl-oxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentyl-phenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclo-hexylcarbonyloxy; amino, such as phenylanilino, 2-chloroanilino, diethylamino and dodecylamino; imino, such as 1 (N-phenylimido)ethyl, N-succinimido or 3-benzyl-hydantoinyl; phosphate, such as dimethylphosphate and ethylbutylphosphate; phosphite, such as diethyl and dihexy-lphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethy-lammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido and sulfamoyl groups wherein the substituents typically contain 1 to 42 carbon atoms. Such substituents can also be further substituted.

The dispersion of a coupler for use in the invention can be incorporated into the photographic element as an emulsified photographic dispersion, prepared by dissolving the material in one or more high-boiling permanent organic solvents, with or without a low-boiling or partially water-soluble auxiliary organic solvent. A blend of permanent solvents may be advantageous to optimize the desired features, such as solubility, dye hue, thermal or light stability or the coupling reactivity of the dispersions.

The resulting organic solution may then be mixed with an aqueous gelatin solution and the mixture passed through a mechanical mixing device suitable for high-shear or turbulent mixing generally suitable for preparing photographic emulsified dispersions, as described in EP-A-1 037 103, incorporated herein by reference. The dispersion particles preferably have an average particle size of less than 2 $\mu$m, generally from about 0.02 to 2 $\mu$m, more preferably from about 0.02 to 0.5 $\mu$m, especially from about 0.02 to 0.3 $\mu$m. These methods are described in detail in U.S. Pat. Nos. 2,322,027, 2,787,544, 2,801,170, 2,801,171, 2,949,360 and 3,396,027, the disclosures of which are incorporated by reference herein.

The aqueous phase of the coupler dispersion for use in the invention preferably comprises gelatin as a hydrophilic colloid. This may be gelatin or a modified gelatin such as acetylated gelatin, phthalated gelatin or oxidized gelatin. Gelatin may be base-processed, such as lime-processed gelatin, or may be acid-processed, such as acid-processed ossein gelatin. Other hydrophilic colloids may also be used, such as a water-soluble polymer or copolymer including, but not limited to poly(vinyl alcohol), partially hydrolyzed poly(vinyl acetate-co-vinyl alcohol), hydroxyethyl cellulose, poly(acrylic acid), poly(1-vinylpyrrolidone), poly (sodium styrene sulfonate), poly(2-acrylamido-2-methane sulfonic acid) and polyacrylamide. Copolymers of these polymers with hydrophobic monomers may also be used.

A surfactant may be present in either the aqueous phase or the organic phase or the dispersions can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution.

An aqueous coating solution in accordance with the present invention may be prepared from the coupler dispersion. Other ingredients may also be contained in this solution such as silver halide emulsions, dispersions or solutions of other photographically useful compounds, additional gelatin, or acids and bases to adjust the pH. These ingredients may then be mixed with a mechanical device at an elevated temperature (e.g. 30 to 50C) for a short period of time (e.g. 5 min to 4 h) prior to coating.

The materials for use in the invention can be used in any of the ways and in any of the combinations known in the art. Typically, the materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Suitable laydowns of total coupler are from about 0.05 mmol/m$^2$ to about 2.0 mmol/m$^2$, preferably from about 0.15 mmol/m$^2$ to about 1.5 mmol/m$^2$, more preferably from about 0.30 mmol/m$^2$ to about 1.2 mmol/m$^2$. The ratio of solvent to coupler (by weight) is from about 0.2:1 to about 5:1, preferably from about 0.5:1 to about 4:1, more preferably from about 0.5:1 to about 2:1.

The photographic elements comprising a coupler dispersion for use in the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler.

The element can be employed with a reflective support, as described in U.S. Pat. No. 5,866,282. The element can contain additional layers, such as filter layers, interlayers, overcoat layers and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230 provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems and processing methods and agents are described in Sections XV to XX. Certain desirable photographic elements and processing steps, particularly those useful in conjunction with color reflective prints, are described in *Research Disclosure*, Item 37038, February 1995. U.S. Pat. No. 5,558,980 discloses loaded latex compositions, such as poly- and t-butylacrylamides which can be incorporated into any photographic coating in any layer to provide extra dye stability.

In color couplers a coupling-off group is a group adapted to split off from the coupler as the result of the reaction between the coupler and the oxidation product of an arylamine color developing agent. Typical examples of such groups are as hereinbefore defined in the Background of the Invention.

Couplers that form cyan dyes upon reaction with oxidized color developing agents are typically phenols, naphthols or pyrazoloazoles, described in such representative patents and publications as U.S. Pat. Nos. 2,367,531, 2,423,730, 2,474,293, 2,772,162, 2,895,826, 3,002,836, 3,034,892, 3,041,236, 4,333,999 and 4,883,746, EP-A-0 544 322, EP-A-0 556 700, EP-A-0 556 777, EP-A-0 565 096, EP-A-0 570 006 and EP-A-0 574 948 and "Farbkuppler-eine Literature Übersicht," published in Agfa Mitteilungen, Band III, pp.56–175 (1961).

Typical cyan couplers are represented by the following formulae:

CYAN-1

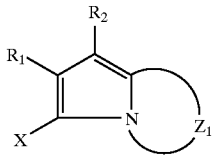

CYAN-2

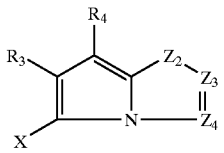

CYAN-3

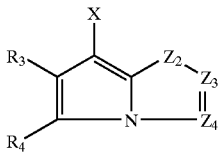

-continued

CYAN-4

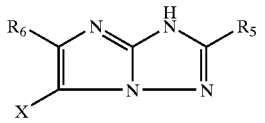

wherein $R_1$, $R_5$ and $R_8$ each represent a hydrogen or a substituent, $R_2$ represents a substituent, $R_3$, $R_4$ and $R_7$ each represent an electron attractive group having a Hammett's substituent constant $s_{para}$ of 0.2 or more and the sum of the $s_{para}$ values of $R_3$ and $R_4$ is 0.65 or more, $R_6$ represents an electron attractive group having a Hammett's substituent constant $s_{para}$ of 0.35 or more, X represents a hydrogen or a coupling-off group, $Z_1$ represents nonmetallic atoms necessary for forming a nitrogen-containing, six-membered, heterocyclic ring which has at least one dissociative group, $Z_2$ represents —C($R_7$)= and —N= and $Z_3$ and $Z_4$ each represent —C($R_8$)= and —N=, or by the formulae:

CYAN-5

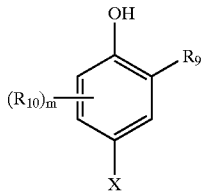

CYAN-6

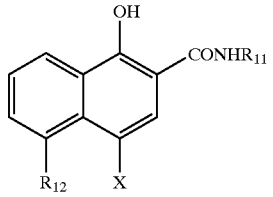

wherein $R_9$ represents a substituent (preferably a carbamoyl, ureido, or carbonamido group), $R_{10}$ represents a substituent (preferably individually selected from halogens, alkyl, and carbonamido groups), $R_{11}$ represents ballast substituent; $R_{12}$ represents a hydrogen or a substituent (preferably a carbonamido or sulfonamido group), X represents a hydrogen or a coupling-off group, and m is an integer from 1–3.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654 and "Farbkuppler-eine Literature Übersicht," published in Agfa Mitteilungen, Band III, pp. 126–156 (1961). Preferably such couplers are pyrazolones, pyrazolotriazoles or pyrazolobenzimidazoles that form magenta dyes upon reaction with oxidized color developing agents.

Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493, 1,252,418, 1,398,979, U.S. Pat. Nos. 4,443,536, 4,514,490, 4,540,654, 4,590,153, 4,665,015, 4,822,730, 4,945,034, 5,017,465 and 5,023,170. Examples of 1H-pyrazolo [1,5-b]-1,2,4-triazoles can be found in EP-A-0 176 804, EP-A-0 177 765 and U.S. Pat. Nos. 4,659,652, 5,066,575 and 5,250,400.

Typical pyrazoloazole and pyrazolone couplers are represented by the following formulae:

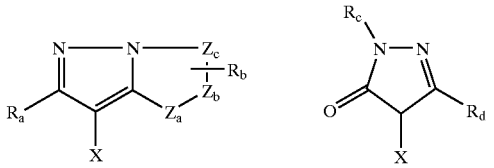

wherein $R_a$ and $R_b$ are independently hydrogen or a substituent, $R_c$ is a substituent (preferably an aryl group), $R_d$ is a substituent (preferably an anilino, carbonamido, ureido, carbamoyl, alkoxy, aryloxycarbonyl, alkoxycarbonyl, or N-heterocyclic group), X is hydrogen or a coupling-off group, and $Z_a$, $Z_b$, and $Z_c$ are independently a substituted methine group, =N—, =C— or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ is a methine group connected to the group $R_b$.

Specific examples of such couplers are:

MAG-1

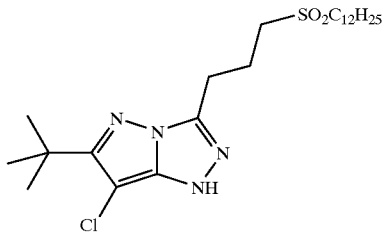

MAG-2

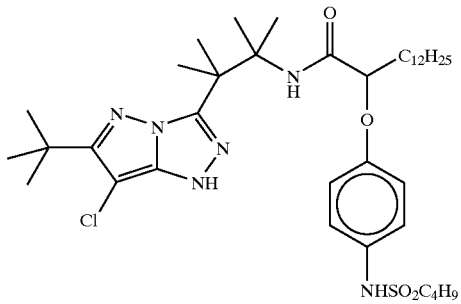

MAG-3

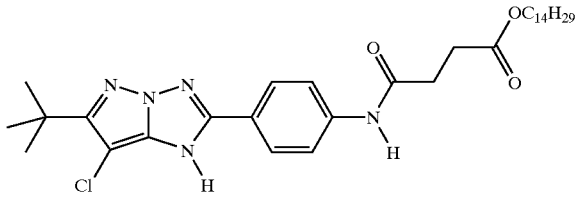

-continued

MAG-4

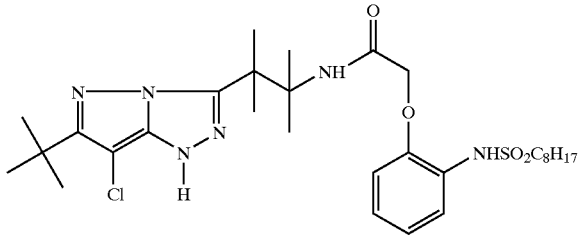

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 3,960,570, 4,022,620, 4,443,536, 4,910,126 and 5,340,703 and "Farbkuppler-eine Literature Übersicht", published in Agfa Mitteilungen, Band III, pp. 112–126 (1961). Such couplers are typically open chain ketomethylene compounds.

Also preferred are yellow couplers such as described in, for example, EP-A-0 482 552, EP-A-0 510 535, EP-A-0 524 540, EP-A-0 543 367 and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulae:

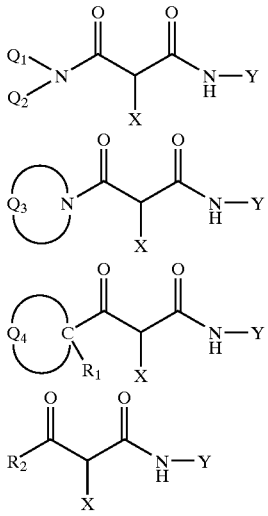

wherein $R_1$, $R_2$, $Q_1$ and $Q_2$ are each a substituent, X is hydrogen or a coupling-off group, Y is an aryl group or a heterocyclic group, $Q_3$ is an organic residue required to form a nitrogen-containing heterocyclic group together with the >N—, and $Q_4$ are nonmetallic atoms necessary to form a 3- to 5-membered hydrocarbon ring or a 3- to 5-membered heterocyclic ring which contains at least one hetero atom selected from nitrogen, oxygen, sulfur and phosphorous in the ring. Particularly preferred is when $Q_1$ and $Q_2$ are each an alkyl group, an aryl group or a heterocyclic group, and $R_2$ is an aryl or tertiary alkyl group.

Preferred yellow couplers have the following structures:

Y-1

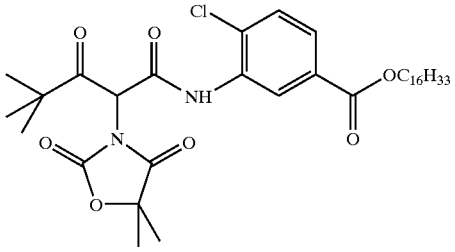

Y-2

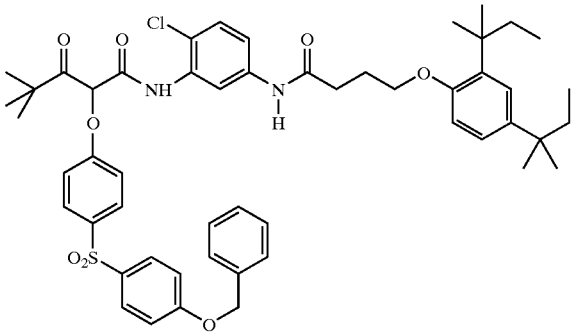

Y-3

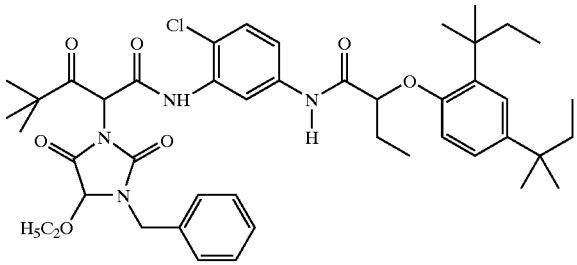

Y-4

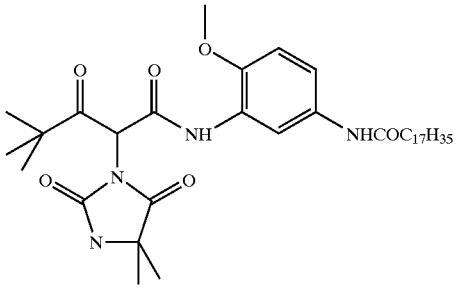

Y-5

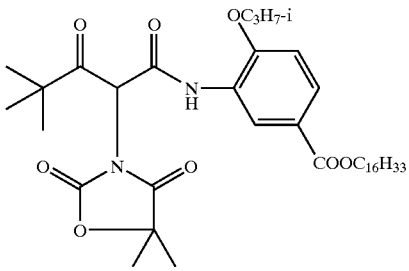

-continued

Y-6

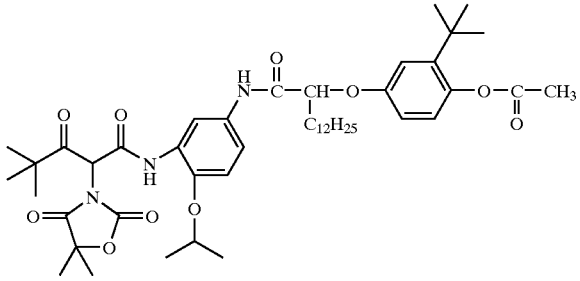

Couplers that form colorless products upon reaction with oxidized color developing agent are described in such representative patents as: U.K. Patent No. 861,138, U.S. Pat. Nos. 3,632,345, 3,928,041, 3,958,993 and 3,961,959. Typically such couplers are cyclic carbonyl-containing compounds that form colorless products on reaction with an oxidized color developing agent.

Couplers that form black dyes upon reaction with oxidized color developing agent are described in such representative patents as U.S. Pat. Nos. 1,939,231, 2,181,944, 2,333,106 and 4,126,461, German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343 and 5,234,800.

It may be useful to use additional couplers any of which may contain known ballasts or coupling-off groups such as those described in U.S. Pat. Nos. 4,301,235, 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP-A-0 213 490, Japanese Published Application 58-172,647, U.S. Pat. Nos. 2,983,608, 4,070,191 and 4,273,861, German Applications DE 2,706,117 and DE 2,643,965, UK Patent No. 1,530,272 and Japanese Application 58-113935. The masking couplers may be shifted or blocked, if desired.

The materials for use in the invention may be used in association with materials that accelerate or otherwise modify the processing steps e.g. of bleaching or fixing to improve the quality of the image. Bleach accelerator releasing couplers such as those described in EP-A-0 193 389; EP-A-0 301 477 and in U.S. Pat. Nos. 4,163,669, 4,865,956 and 4,923,784, may be useful. Also contemplated is use of the compositions in association with nucleating agents, development accelerators or their precursors (UK Patent Nos. 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols and non color-forming couplers.

The materials for use in the invention may also be used in combination with filter dye layers comprising colloidal silver sol or yellow, cyan and/or magenta filter dyes, either as oil-in-water dispersions, latex dispersions or as solid particle dispersions. Additionally, they may be used with "smearing" couplers (e.g. as described in U.S. Pat. Nos. 4,366,237, 4,420,556, 4,543,323 and in EP-A-0 096 570). Also, the compositions may be blocked or coated in protected form as described, for example, in Japanese Application 61/258,249 or U.S. Pat. No. 5,019,492.

The materials for use in the invention may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578, 3,148,022, 3,148,062, 3,227,554, 3,384,657, 3,379,529, 3,615,506, 3,617,291, 3,620,746, 3,701,783, 3,733,201, 4,049,455, 4,095,984, 4,126,459, 4,149,886, 4,150,228, 4,211,562, 4,248,962, 4,259,437, 4,362,878, 4,409,323, 4,477,563, 4,782,012, 4,962,018, 4,500,634, 4,579,816, 4,607,004, 4,618,571, 4,678,739, 4,746,600, 4,746,601, 4,791,049, 4,857,447, 4,865,959, 4,880,342, 4,886,736, 4,937,179, 4,946,767, 4,948,716, 4,952,485, 4,956,269, 4,959,299, 4,966,835, 4,985,336 as well as in patent publications GB 1,560,240, GB 2,007,662, GB 2,032,914, GB 2,099,167, DE 2,842,063, DE 2,937,127, DE 3,636,824, DE 3,644,416 as well as the following European Patent Publications: EP-A-0 272 573, EP-A-0 335 319, EP-A-0 336 411, EP-A-0 346 899, EP-A-0 362 870, EP-A-0 365 252, EP-A-0 365 346, EP-A-0 373 382, EP-A-0 376 212, EP-A-0 377 463, EP-A-0 378 236, EP-A-0 384 670, EP-A-0 396 486, EP-A-0 401 612 and EP-A-0 401 613.

Such compounds are also disclosed in "Developer-Inhibitor-Releasing (DIR) Couplers for Color Photography," C. R. Barr, J. R. Thirtle and P. W. Vittum in Photographic Science and Engineering, Vol.13, p.174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulae:

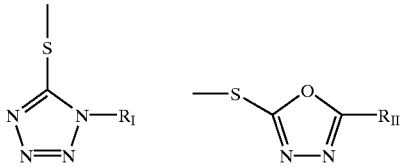

-continued

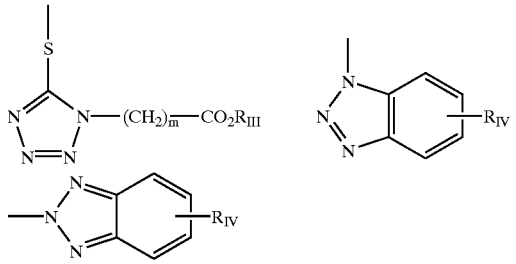

wherein $R_I$ is selected from the group consisting of straight and branched alkyl groups of from 1 to about 8 carbon atoms, benzyl, phenyl and alkoxy groups and such groups containing none, one or more than one such substituent, $R_{II}$ is selected from $R_I$ and —$SR_I$, $R_{III}$ is a straight or branched alkyl group of from 1 to about 5 carbon atoms and m is from 1 to 3, and $R_{IV}$ is selected from the group consisting of hydrogen, halogens and alkoxy, phenyl and carbonamido groups, —$COOR_V$ and —$NHCOOR_V$, wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group, such as groups using an intramolecular nucleophilic substitution reaction (U.S. Pat. No. 4,248,962); groups utilizing an electron transfer reaction along a conjugated system (U.S. Pat. Nos. 4,409,323, 4,421,845 and 4,861,701 and Japanese Applications 57-188035; 58-98728; 58-209736; 58-209738); groups utilizing ester hydrolysis (German Patent Application (OLS) No. 2,626,315); groups that function as a coupler or reducing agent after the coupler reaction (U.S. Pat. Nos. 4,438,193 and 4,618,571) and groups that combine the features described above. It is typical that the timing group is of one of the formulae:

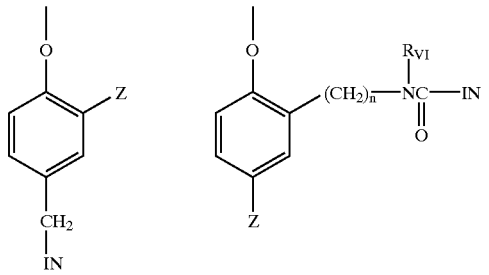

wherein

IN is the inhibitor moiety, Z is selected from the group consisting of nitro, cyano, alkylsulfonyl, sulfamoyl (—$SO_2NR_2$) and sulfonamido (—$NRSO_2R$) groups, n is 0 or 1, and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde or other low molecular weight by-products. The groups are exemplified in EP-A-0 464 612, EP-A-0 523 451, U.S. Pat. No. 4,146,396 and Japanese Kokai 60-249148 and 60-249149.

Suitable developer inhibitor-releasing couplers that may be included in photographic light sensitive emulsion layer include, but are not limited to, the following:

D1

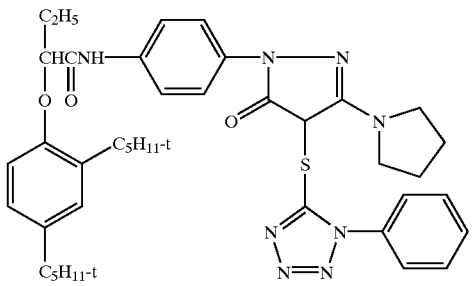

D2

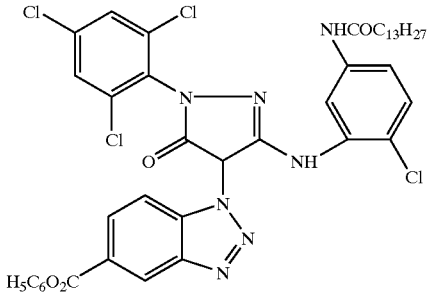

D3

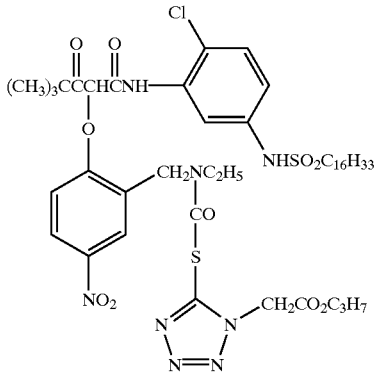

D4

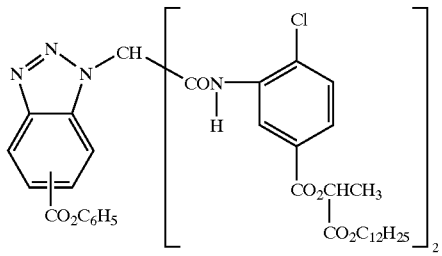

-continued

D5

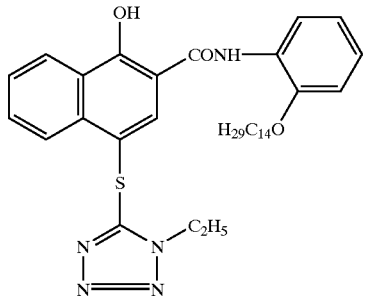

D6

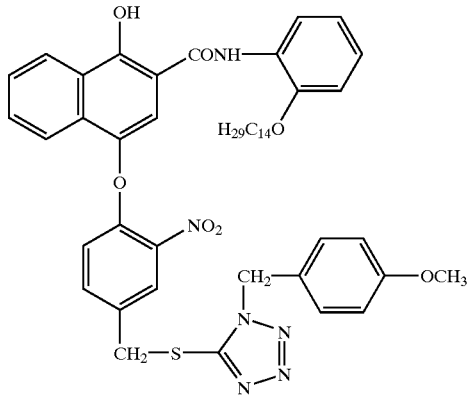

D7

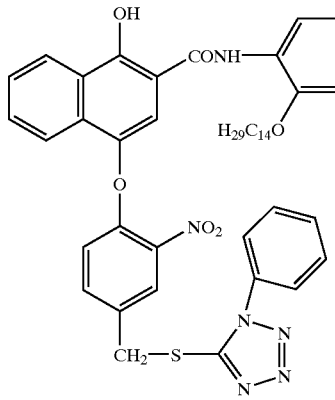

D8

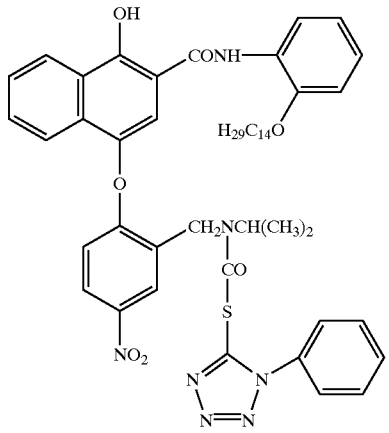

-continued

D9

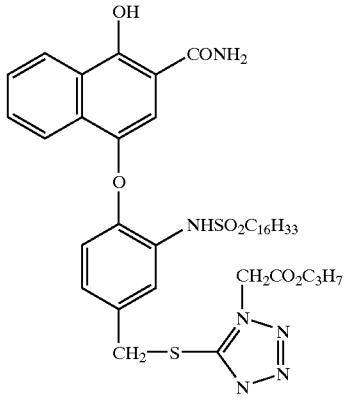

D10

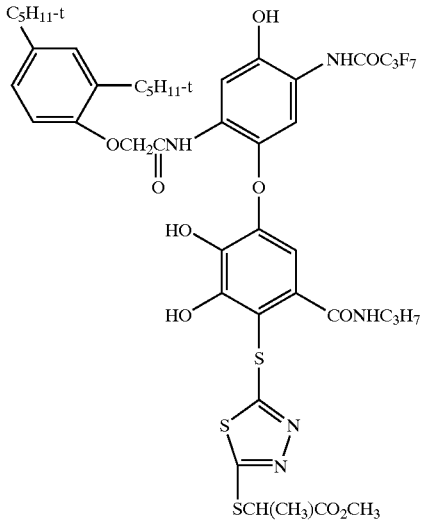

D11

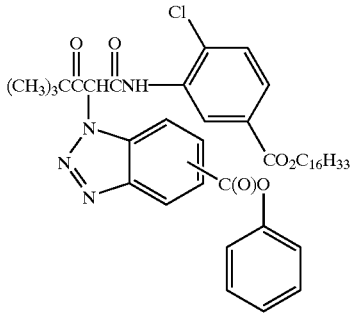

D12

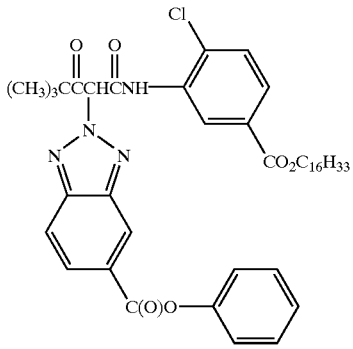

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994, on a support with reduced oxygen permeability (EP-A-0 553 339), with epoxy solvents (EP-A-0 164 961), with nickel complex stabilizers (U.S. Pat. Nos. 4,346,165, 4,540,653 and 4,906,559 for example), with ballasted chelating agents such as those in U.S. Pat. No. 4,994,359 to reduce sensitivity to polyvalent cations such as calcium and with stain reducing compounds such as described in U.S. Pat. No. 5,068,171. Other compounds useful in combination with the invention are disclosed in Japanese Published Applications described in Derwent Abstracts having accession numbers as follows: 90–072,629, 90-072,630, 90-072,631, 90-072,632, 90-072,633, 90-072,634, 90-077,822, 90-078,229, 90-078,230, 90-079,336, 90-079,337, 90-079,338, 90-079,690, 90-079,691, 90-080,487, 90-080,488, 90-080,489, 90-080,490, 90-080,491, 90-080,492, 90-080,494, 90-085,928, 90-086,669, 90-086,670, 90-087,360, 90-087,361, 90-087,362, 90-087,363, 90-087,364, 90-088,097, 90-093,662, 90-093,663, 90-093,664, 90-093,665, 90-093,666, 90-093,668, 90-094,055, 90-094,056, 90-103,409, 83-62,586 and 83-09,959.

Any silver halide combination can be used for the photographic element, such as silver chloride, silver chlorobromide, silver chlorobromoiodide, silver bromide, silver bromoiodide or silver chloroiodide. In cases where the emulsion composition is a mixed halide, the minor component may be added in the crystal formation or after formation as part of the sensitization or melting. The shape of the silver halide emulsion grain can be cubic, pseudo-cubic, octahedral, tetradecahedral or tabular. The emulsions may be precipitated in any suitable environment such as a ripening environment, a reducing environment or an oxidizing environment.

Emulsion addenda that adsorb to grain surfaces, such as antifoggants, stabilizers and dyes can also be added to the emulsions during precipitation. Chemical sensitization of the materials in this photographic element is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

Tabular grain silver halide emulsions may be used in the present invention. Specifically contemplated tabular grain emulsions are those in which greater than 50 percent of the total projected area of the emulsion grains are accounted for by tabular grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

wherein

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520, 4,414,310, 4,433,048, 4,643,966, 4,647,528, 4,665,012, 4,672,027, 4,678,745, 4,693,964, 4,713,320, 4,722,886, 4,755,456, 4,775,617, 4,797,354, 4,801,522, 4,806,461, 4,835,095, 4,853,322, 4,914,014, 4,962,015, 4,985,350, 5,061,069 and 5,061,616.

The emulsions can be surface-sensitive emulsions, i.e. emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41™ color process as described in The British Journal of Photography Annual of 1988, pp 191–198. Where applicable, the element may be processed in accordance with color print processes such as the RA-4™ process of Eastman Kodak Company as described in the British Journal of Photography Annual of 1988, pp 198–199. Such negative working emulsions are typically sold with instructions to process using a color negative method such as the C-41™ or RA-4™ process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6™. Alternatively, a direct positive emulsion can be employed to obtain a positive image.

The multicolor photographic elements of the invention may be processed alternatively in a developer solution that will provide reduced processing times of one minute or less (dry to dry), and particularly reduced color development times of less than about 25 seconds, such that all color records are fully developed with aim sensitometry.

Preferred color developing agents are p-phenylenediamines such as:

4-amino-N,N-diethylaniline hydrochloride,
4-amino-3-methyl-N,N-diethylaniline hydrochloride,
4-amino-3-methyl-N-ethyl-N-(2-methanesulfonamidoethyl) aniline sesquisulfate hydrate,
4-amino-3-methyl-N-ethyl-N-(2-hydroxyethyl)aniline sulfate,
4-amino-3-(2-methanesulfonamidoethyl)-N,N-diethylaniline hydrochloride and
4-amino-N-ethyl-N-(2-methoxyethyl)-m-toluidine di-p-toluene sulfonic acid.

Development is usually followed by the conventional steps of bleaching, fixing or bleach-fixing, to remove silver or silver halide, washing and drying.

The coupler dispersions may be coated with emulsions to form photographic elements at very low levels of silver (generally less than 100 mg/m$^2$). Reasons for doing this include reducing cost, reducing the thickness of silver halide emulsion layers to gain sharpness advantages and reducing the environmental impact during and after processing.

One class of low silver photographic material is color material intended for redox amplification processes wherein the developed silver acts as a catalyst to the formation of the dye image. This process can take place in a low volume thin processor, such as a low volume thin tank (LVTT), for example, as disclosed in U.S. Pat. No. 5,436,118. Redox amplification processes have been described for example in GB Patent Nos. 1,268,126, 1,399,481, 1,403,418, 1,560,572 and U.S. Pat. Nos. 3,748,138, 3,822,129 and 4,097,278. In such processes, color materials are developed to produce a silver image (which may contain only small amounts of silver) and are then treated with a redox amplifying solution (or a combined developer-amplifier) to form a dye image.

The invention will now be described with reference to the following examples, which should not, however, be construed as limiting the scope thereof.

EXAMPLES

Preparative Examples

The cyan couplers of formula (IIA) (a) and (b) may be prepared according to the methods described in EP-A-0 744

655 and EP-A-0 802 454. The magenta couplers of formula (IIA) (b) may be synthesized as described in EP-A-0 119 860 and U.S. Pat. No. 5,451,501, whilst the cyan and magenta couplers of formula (IIA) (d) may be prepared as described in U.S. Pat. Nos. 4,916,051 and 5,776,669 respectively. The cyan couplers of formula (IIA) (c) may be synthesized according to the method described in EP-A-0 269 436 whilst those of formula (IIB) (e), (f) and (i) may be prepared as described in U.S. Pat. No. 4,950,585. The cyan couplers of formula (IIB) (g) and (h) may be prepared according to the syntheses described in EP-A-0 398 664 and JP 04125557 respectively and those of formula (IIB) (j) as disclosed in U.S. Pat. No. 4,970,142. The cyan couplers of formula (III) may be prepared as described in EP-A-0 714 892, EP-A-0 883 024 and U.S. Pat. No. 6,132,945.

The couplers for use in the invention can be prepared according to the procedure outlined below for the preparation of M-2.

(a) Preparation of Intermediate (2)

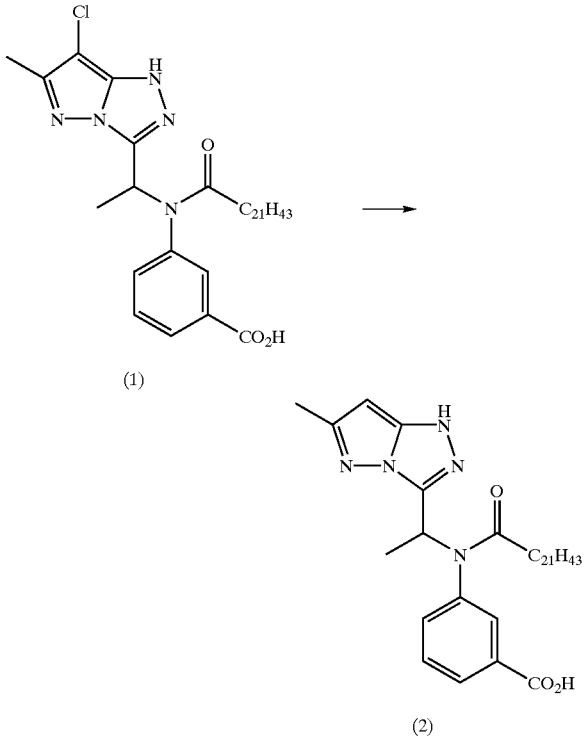

Ethanol (300 ml) was added to a mixture of (1) (CAS Reg No. 192317-69-4; 30.0 g, 65.0 mmol) and 10% palladium on carbon (1 g) under an atmosphere of nitrogen. The reaction was then stirred under hydrogen at 30 atm initial pressure and at 100C (pressure rose to about 40 atm) for 6 h then was allowed to cool overnight. The catalyst was removed by filtration through Kieselguhr and the filtrate concentrated in vacuo to give a pale green oil (31.30 g). A solution of sodium hydroxide (12.22 g, 0.306 mol) in water (25 ml) was added to a stirred solution of the oil in a mixture of tetrahydrofuran (50 ml) and methanol (300 ml). Some material came out of solution. The reaction was heated at reflux for 3 h. The solvent was removed in vacuo then the residue was treated with water (400 ml) and made acidic with concentrated hydrochloric acid (50 ml). The solid which had formed was extracted into ethyl acetate (3×200 ml), then the organic solution was dried (magnesium sulfate) and concentrated in vacuo. This gave the title compound (25.24 g) as a buff solid.

(b) Preparation of Intermediate (4)

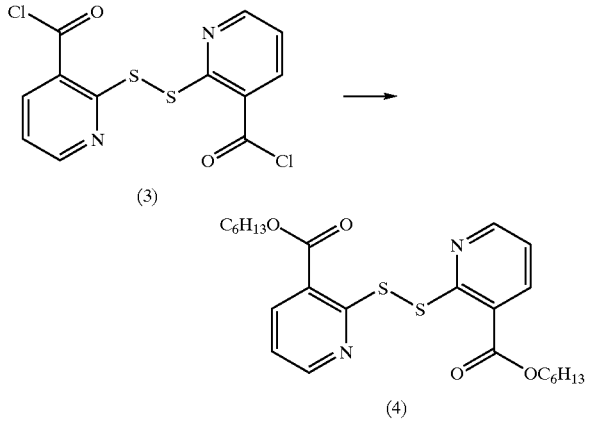

Hexanol (1.18 g, 11.6 mmol) was added to a stirred suspension of (3) (CAS Reg No. 104857-34-43; 2.00 g, 5.80 mmol) in a mixture of tetrahydrofuran (10 ml) and pyridine (10 ml) containing 4-(dimethylamino)pyridine (catalytic amount). The reaction was stirred for 3 h then the solvent was removed in vacuo. The residue was taken up in a mixture of dilute hydrochloric acid (200 ml) and warm ethyl acetate (100 ml). Some solid remained and this was removed by filtration. The organic solution was dried (magnesium sulfate) and concentrated in vacuo. The solid was added to hot ethyl acetate and, after 30 min, all the insoluble material was removed from the hot suspension. The filtrate was concentrated in vacuo to give the title compound (1.35 g) as a yellowish solid.

(c) Preparation of M-2 (5)

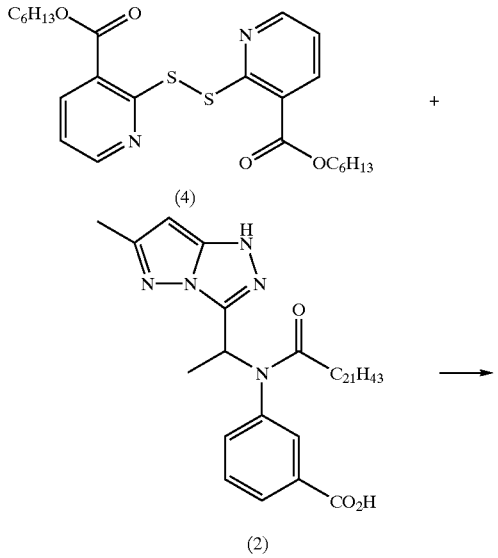

-continued

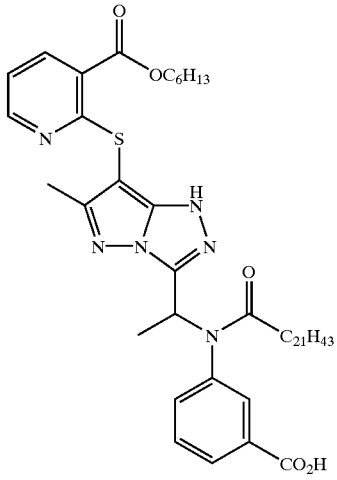

(5)

A solution of bromine (0.46 g, 2.84 mmol) in dry dimethylformamide (1 ml) was added dropwise over about 5 min to a stirred suspension of (4) (1.35 g, 2.84 mmol) and (2) (3.44 g, 5.67 mmol) in dry dimethylformamide (10 ml). The solid dissolved over a period of about 20 min. The reaction was stirred for 1 h then was added with stirring to water (400 ml). After 30 min the solid which had formed was removed by filtration and dissolved in ethyl acetate (10 ml). The organic solution was dried (magnesium sulfate) and concentrated in vacuo to give an orange oil (4.67 g). This was purified by column chromatography over silica (eluent 19:1 dichloromethane/methanol) to give the title compound, M-2, (2.91 g) as a yellow foam.

Photographic Examples

Compounds for use in the present invention (and control compounds) were dispersed in coupler solvent and incorporated into photographic coatings containing a silver bromoiodide emulsion, on a transparent support, according to the coating diagram shown in TABLE 1 below.

TABLE 1

| Structure of Photographic Element | | |
|---|---|---|
| Gel Supercoat | Gelatin | 1.000 g/m$^2$ |
| | Bis(vinylsulfonyl)methane (hardener) | 0.069 g/m$^2$ |
| Emulsion Layer | Silver bromoiodide | 1.076 g/m$^2$ |
| | Coupler | 0.473 mmol/m$^2$ |
| | Gelatin | 2.420 g/m$^2$ |
| Support | Cellulose Acetate (with Gel U-coat and Removable Carbon Antihalation Backing) | |

Aqueous dispersions of the couplers were prepared by methods known in the art. The magenta dye-forming coupler dispersions contained 8% by weight of gelatin, 5% by weight of coupler and a 1:2:3 weight ratio of coupler to tricresyl phosphate coupler solvent to 2-(2-butoxyethoxy) ethyl acetate auxiliary solvent. The auxiliary solvent was included to aid in dispersion preparation and was removed by washing the dispersion for 6 h at 4C and pH 6.0.

(i) Sensitometric Testing

The experimental photographic coatings prepared in this way were slit and chopped into 30 cm×35 mm test strips. After hardening the strips were exposed (0.02 s) through a 0–4.0 neutral density step wedge (0.2 ND step increments) and Daylight V and Wratten™ 74 filters and then processed through a standard C-41™ process as described in the British Journal of Photography Annual (1988) 196–198 using the following steps and process times:

| | |
|---|---|
| Developer | 2.5 min |
| Bleach | 4.0 min |
| Wash | 2.0 min |
| Fix | 4.0 min |
| Wash | 2.0 min |

For each test strip, Status M densities were measured as a function of exposure using a spectral array automatic transmission densitometer. Measurements of sensitometric parameters—minimum density ($D_{min}$), maximum density ($D_{max}$) and contrast (γ)—were obtained from plots of density vs. log exposure (DlogE curves) and are shown in TABLE 2, wherein the structures of M1, M2, CC1 and CC2 are derived from the following general formula:

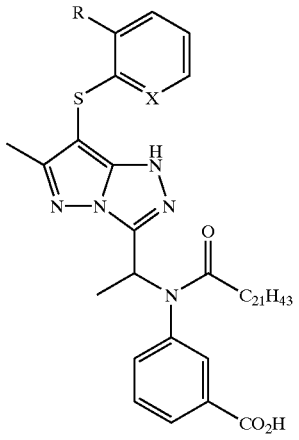

and CC3, CC4 and CC5 have the following structures:

CC3

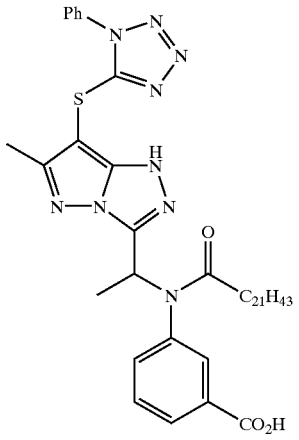

-continued

CC4

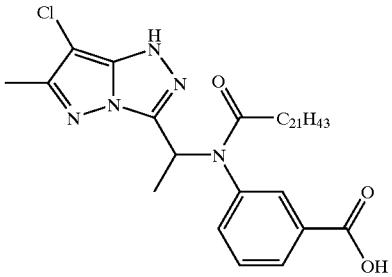

CC5

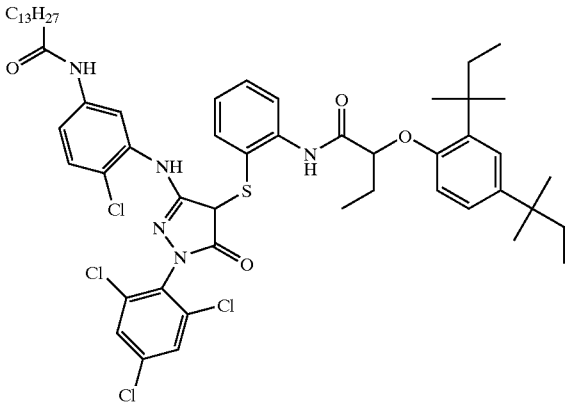

TABLE 2

| Compound No | R | X | Contrast (γ) | $D_{min}$ | $D_{max}$ |
|---|---|---|---|---|---|
| CC1 | $CO_2H$ | CH | 0.47 | 0.08 | 0.78 |
| M1 | $CO_2H$ | N | 1.10 | 0.16 | 1.12 |
| CC2 | $CO_2C_6H_{13}$ | CH | 0.32 | 0.05 | 0.49 |
| M2 | $CO_2C_6H_{13}$ | N | 0.98 | 0.11 | 1.16 |
| CC3 | N/A | N/A | 0.10 | 0.05 | 0.23 |
| CC4 | N/A | N/A | 1.39 | 0.32 | 1.40 |
| CC5 | N/A | N/A | 1.51 | 0.24 | 1.71 |

The data in TABLE 2 show that, in comparison to the control coupler CC1, the compound of formula (I) M1 is more active as can be seen from the significantly higher contrast and $D_{max}$. This effect is also seen in the comparison of the control coupler CC2 with the compound of formula (I) M2. Neither M1 nor M2 caused significant inhibition of the development process as can be seen by comparing their contrast and $D_{max}$ with the very low contrast and $D_{max}$ obtained with the control coupler CC3, which is a development inhibitor releasing coupler, differing only in having a phenylmercaptotetrazole coupling-off group.

Data for control magenta image couplers CC4 and CC5 were included for comparison purposes. CC4 differs only from M1 and M2 in having a chloro coupling-off group instead of a heterocyclylthio group. Although CC4 showed good activity it is not possible to link a PUG thereto. CC5 is a single ring i.e. non-fused heterocyclic coupler, namely a pyrazolone coupler, which exhibited good activity but dyes derived therefrom are known to have less good color reproduction characteristics than dyes derived from the structures of couplers M1 and M2.

(ii) Investigation of Silver Inhibition Effects

A set of 35 mm strips was exposed for 0.02 s through a 0–1.8 neutral density step wedge (0.3 ND increments) and Daylight V, Wratten™ 74 and 0.98ND filters and processed through a modified C-41™ process, in which the bleach step was omitted and a stopbath (1% acetic acid solution) was inserted after the developer step, using the following processing sequence:

| | |
|---|---|
| Developer | 2.5 min |
| Stopbath | 1.0 min |
| Wash | 2.0 min |
| Fix | 4.0 min |
| Wash | 2.0 min |

The strips processed through the "no bleach" process were subjected to X-ray fluorescence (XRF) analysis to determine the amount of developed silver in each of the seven steps of the processed strip. Silver development curves (developed silver in mg/m$^2$ vs. step number (or log exposure)) were then created.

Neither M1 nor M2 showed significant inhibition as exemplified for M2 in FIG. 1, which shows an increase in the amount of developed silver with increasing amount of exposure. In contrast, CC3 showed a negligible amount of developed silver that did not increase with increasing exposure, indicating that CC3 caused a significant amount of inhibition.

(iii) Investigation of Bleach Acceleration Effects:

A set of 35 mm strips was exposed for 0.02 s through a 0–1.8 neutral density step wedge (0.3 ND increments) and Daylight V, Wratten™ 74 and 0.98ND filters and processed through a C-41™ process, in which the normal bleach solution was substituted with one of significantly reduced bleaching capacity, using the following steps and process times:

| | |
|---|---|
| Developer | 2.5 min |
| Bleach | 4.0 min |
| Wash | 2.0 min |
| Fix | 4.0 min |
| Wash | 2.0 min |

The replacement bleach was prepared by taking a seasoned C-41™ bleach and diluting it to 5% of its original concentration. Strips processed in this way were then submitted for XRF silver analysis as in (ii) above in order to measure the amount of residual silver in the strips after a bleach step of 4 min.

The % residual silver for coatings containing each coupler was then calculated using the following formula:

$$\%\ \text{Residual Ag} = \frac{[\text{Ag in } D_{max}(\text{4 min bleach})]}{[\text{Ag in } D_{max}(\text{no bleach})]} \times 100$$

where Ag in $D_{max}$ is measured in mg/m$^2$ (by XRF)

The values of % residual silver for M1 and M2 were compared with those obtained for CC1 and CC2 and also for the typical magenta coupler CC5, which does not show bleach acceleration, and presented hereunder in TABLE 3.

TABLE 3

| Compound No | $R_1$ | X | % Residual Silver |
|---|---|---|---|
| CC1 | $CO_2H$ | CH | 8.0 |
| M1 | $CO_2H$ | N | 26.4 |
| CC2 | $CO_2C_6H_{13}$ | CH | 13.4 |
| M2 | $CO_2C_6H_{13}$ | N | 44.8 |
| CC5 | N/A | N/A | 7.0 |

The data in TABLE 3 show that the elements containing couplers M1 and M2 and control couplers CC1 and CC2 have at least as much residual silver as control coupler CC5, indicating that they are not bleach accelerators. If they did show bleach acceleration there would be less residual silver.

It should be emphasized that in a normal C-41™ process, using a standard undiluted bleach, there would be no residual silver retained in coatings containing M1 or M2 after a 4 min bleach step.

The invention has been described in detail with particular reference to certain preferred embodiments thereof, but it will be understood that variations and modifications can be effected within the spirit and scope of the invention.

What we claim is:

1. A photographic element comprising at least one light-sensitive silver halide emulsion layer having associated therewith a heterocyclic magenta or cyan dye-forming coupler of formula (I), (I)

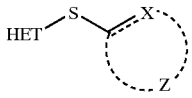

wherein

HET is a heterocyclic coupler comprising at least two fused rings and having at least one bridgehead nitrogen atom;

S is bonded to a position of HET capable of releasing the heterocyclylthio moiety from HET upon reaction with oxidized developer;

X is a heteroatom selected from nitrogen, oxygen and sulfur, bonded to the carbon atom bearing the exocyclic S and to other ring atoms only; and Z are the atoms necessary to complete an unsubstituted or substituted heterocyclic ring or ring system, which may contain one or more other heteroatoms selected from nitrogen, oxygen and sulfur;

provided also that the heterocyclylthio moiety released upon reaction with oxidized developer does not significantly inhibit silver development nor cause a bleach acceleration effect.

2. An element as claimed in claim 1 wherein the compound of formula (I) has one of the formulae (II) and (III):

(II)

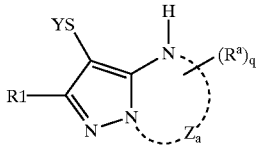

-continued (III)

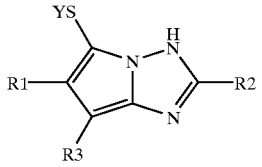

wherein $R^1$, $R^2$ and $R^3$ are independently hydrogen or a substituent;

each $R^a$ is an independently selected substituent and two $R_a$ groups may join to form a ring;

q is 0 to 4;

$Z^a$ represents the atoms necessary to complete an unsubstituted or substituted heterocyclic ring or ring system which may contain one or more other heteroatoms selected from nitrogen, oxygen and sulfur;

providing that each $R^a$ is attached to a carbon atom of the ring; and

Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

3. An element as claimed in claim 2 wherein the compound of formula (II) has the formula (IIA):

(IIA)

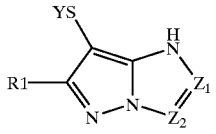

wherein $Z^1$ and $Z^2$ are independently nitrogen atoms, —CH— groups or —CR— groups, wherein R is a substituent; or when both $Z^1$ and $Z^2$ are —CR— groups they may combine to form an unsubstituted or substituted ring or ring system;

$R^1$ is hydrogen or a substituent; and

Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

4. An element as claimed in claim 3 wherein the compound of formula (IIA) has one of the formulae:

(a)

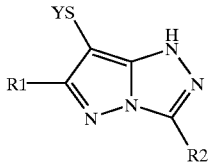

(b)

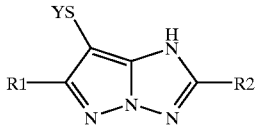

(c)

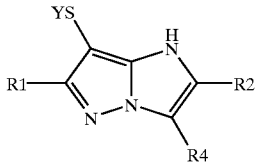

(d)

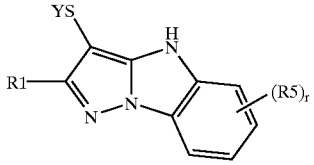

wherein $R^1$, $R^2$, $R^4$ and each $R^5$ are independently hydrogen or a substituent;

or $R^2$ and $R^4$ may combine to form an unsubstituted or substituted ring or ring system;

r is 0 to 4; and

Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

5. An element as claimed in claim 2 wherein the compound of formula (II) has the formula (IIB):

(IIB)

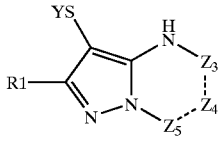

wherein one of $Z^3$ and $Z^5$ is a carbonyl or sulfonyl group and the other of $Z^3$ and $Z^5$ is a nitrogen atom, CH— or —CR— group, wherein R is a substituent;

$Z^4$ is a nitrogen atom or a —CH— or —CR— group; or $Z^4$ and the other of $Z^3$ and $Z^5$ may together form an unsubstituted or substituted ring or ring system;

$R^1$ is hydrogen or a substituent; and

Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

6. An element as claimed in claim 5 wherein the compound of formula (IIB) has one of the formulae:

(e)

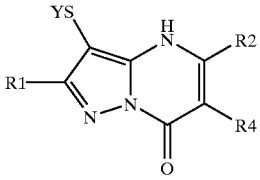

(f)

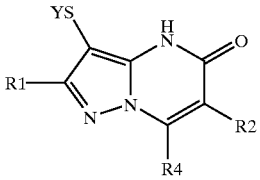

(g)

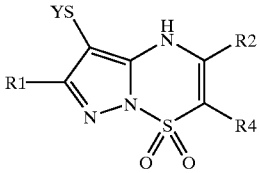

(h)

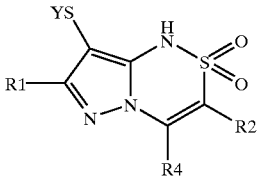

(i)

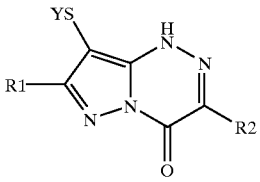

(j)

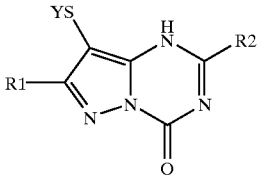

wherein $R^1$, $R^2$ and $R^4$ and are independently hydrogen or a substituent; or $R^2$ and $R^4$ may combine to form an unsubstituted or substituted ring or ring system; and Y is a heterocyclic ring or ring system having a heteroatom X selected from nitrogen, oxygen and sulfur, bonded to the carbon atom bearing the exocyclic S and to other ring atoms only and having atoms Z necessary to complete an unsubstituted or substituted heterocyclic ring or ring system, which may contain one or more other heteroatoms selected from nitrogen, oxygen and sulfur.

7. An element as claimed in claim 2 wherein $R^1$, $R^2$, $R^3$ and $R^4$ and $R^a$ may be independently selected from hydrogen, cyano, fluoro, chloro, bromo, iodo, nitro, carboxylic acid, sulfonic acid; or an unsubstituted or substituted alkyl, aryl, heterocyclyl, alkoxy, aryloxy, alkyl- or aryl-carbonyl, alkyl- or aryl-oxycarbonyl, alkyl- or aryl-carbonyloxy, acyloxy, carbonamido, alkyl- or aryl-carbonamido, alkyl- or aryl-oxycarbonylamino, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfamoylamino, alkyl- or aryl-sulfonamido, alkyl- or aryl-thio, alkyl- or aryl-phosphonate, alkyl- or aryl-amino, alkyl- or aryl-ureido or alkyl- or aryl-carbamoyl group.

8. An element as claimed in claim 7 wherein $R^1$ is selected from a cyano or an unsubstituted or substituted alkyl, aryl, alkoxy, aryloxy, alkyl- or aryl-carbamoyl or alkyl- or aryl-carbonamido group.

9. An element as claimed in claim 7 wherein $R^2$ and $R^3$ are independently selected from hydrogen or an unsubstituted or substituted alkyl, aryl, alkyl- or aryl-oxycarbonyl or alkyl- or aryl-carbonyloxy group.

10. An element as claimed in claim 7 wherein $R^4$ is hydrogen or $R^2$ and $R^4$ may join to form an unsubstituted or substituted 5- to 10-membered carbocyclic or heterocyclic ring which may contain one or more heteroatoms selected from nitrogen, oxygen and sulfur, which ring is unsubstituted or substituted.

11. An element as claimed in claim 7 wherein each $R^5$ is independently hydrogen or a substituent at either or both of the positions of the phenyl ring not adjacent to the carbon atoms shared with the adjoining ring.

12. An element as claimed in claim 2 wherein Y is a 5- to 10-membered unsubstituted or substituted heterocyclic ring or ring system which may contain one or more other heteroatoms selected from nitrogen, oxygen and sulfur and which may include one or more carbonyl groups.

13. An element as claimed in claim 12 wherein Y is a pyridine, pyrimidine, pyrazine, triazine, pyridazine, thiazole, isothiazole, oxazole, imidazole, pyrazole, isoxazole, oxazine, pyrrole, cyclopentadienylpyrrole, triazepine or thiin.

14. An element as claimed in claim 12 wherein Y is substituted with a cyano, carboxylic acid, or an unsubstituted or substituted alkyl- or aryl-carbonyloxy, alkyl- or aryl-oxycarbonyl, alkyl- or aryl-sulfonamido, alkyl- or aryl-sulfamoyl, alkyl- or aryl-carbonamido, alkyl- or aryl-carbamoyl, alkyl- or aryl-amino, alkoxy, aryloxy or heterocyclyl, alkylidene, azomethine or imino group or the ring or rings of Y include one or more carbonyl groups.

15. An element as claimed in claim 12 wherein Y comprises or is linked to a photographically useful group by an unsubstituted or substituted alkyl, aryl, heterocyclyl, alkyl- or aryl-carbamoyl, alkyl- or aryl-carbonamido, alkyl- or aryl-sulfonamido, alkyl- or aryl-sulfamoyl, alkyl- or aryl-carbonyloxy, alkyl- or aryl-ester, alkyl- or aryl-sulfone, alkyl- or aryl-sulfoxide, alkyl- or aryl-sulfide, alkyl- or aryl-amino or alkyl- or aryl-ether group.

16. An element according to claim 1 wherein the compound of formula (I) has the structure:

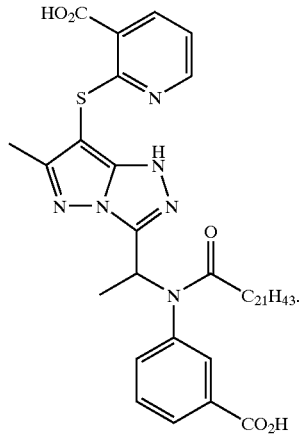

17. An element as claimed in claim 1 wherein the compound of formula (I) has the structure:

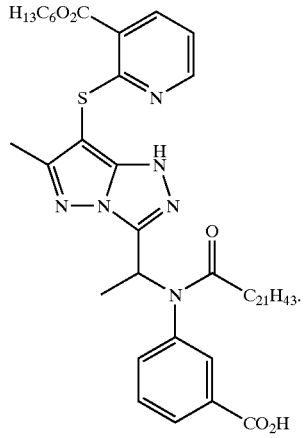

18. An element as claimed in claim 1 wherein the laydowns of total coupler are from about 0.05 mmol/$m^2$ to about 2.0 mmol/$m^2$.

19. An element as claimed in claim 1 wherein the ratio of solvent to total coupler (by weight) is from about 0.2:1 to about 5:1.

20. A multi-color photographic element comprising a support bearing yellow, magenta and cyan image-dye-forming units comprising at least one blue-, green- or red-sensitive silver halide emulsion layer having associated therewith at least one yellow, magenta or cyan dye-forming coupler respectively, wherein the element includes a heterocyclic magenta or cyan dye-forming coupler of formula (I),

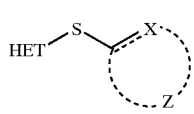

(I)

wherein

HET is a heterocyclic coupler comprising at least two fused rings and having at least one bridgehead nitrogen atom;

S is bonded to a position of HET capable of releasing the heterocyclylthio moiety from HET upon reaction with oxidized developer;

X is a heteroatom selected from nitrogen, oxygen and sulfur, bonded to the carbon atom bearing the exocyclic S and to other ring atoms only; and Z are the atoms necessary to complete an unsubstituted or substituted heterocyclic ring or ring system, which may contain one or more other heteroatoms selected from nitrogen, oxygen and sulfur;

provided also that the heterocyclylthio moiety released upon reaction with oxidized developer does not significantly inhibit silver development nor cause a bleach acceleration effect.

21. A process of forming an image in a photographic element as hereinbefore defined after the element has been imagewise exposed to light, comprising contacting the element with a color developing agent, wherein the element comprises at least one light-sensitive silver halide emulsion layer having associated therewith a heterocyclic magenta or cyan dye-forming coupler of formula (I), (I)

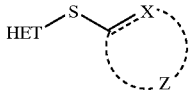

wherein

HET is a heterocyclic coupler comprising at least two fused rings and having at least one bridgehead nitrogen atom;

S is bonded to a position of HET capable of releasing the heterocyclylthio moiety from HET upon reaction with oxidized developer;

X is a heteroatom selected from nitrogen, oxygen and sulfur, bonded to the carbon atom bearing the exocyclic S and to other ring atoms only; and Z are the atoms necessary to complete an unsubstituted or substituted heterocyclic ring or ring system, which may contain one or more other heteroatoms selected from nitrogen, oxygen and sulfur;

provided also that the heterocyclylthio moiety released upon reaction with oxidized developer does not significantly inhibit silver development nor cause a bleach acceleration effect.

* * * * *